United States Patent [19]

Ponn et al.

[11] Patent Number: 4,929,196

[45] Date of Patent: May 29, 1990

[54] INSERT MOLDED FILTER CONNECTOR

[75] Inventors: Timothy R. Ponn, Aurora; Mark Gutierrez, Joliet; Robert J. Gugelmeyer, Aurora, all of Ill.

[73] Assignee: Molex Incorporated, Lisle, Ill.

[21] Appl. No.: 387,731

[22] Filed: Aug. 1, 1989

[51] Int. Cl.[5] ..... H01R 13/66

[52] U.S. Cl. ..... 439/620; 333/185

[58] Field of Search ..... 439/620, 606, 608, 736; 333/181-185

[56] References Cited

U.S. PATENT DOCUMENTS

| | | | |
|---|---|---|---|
| 4,215,326 | 7/1980 | Hollyday | 439/620 |
| 4,329,665 | 5/1982 | Kawai et al. | 439/620 |
| 4,407,552 | 10/1983 | Watanabe et al. | 439/620 |
| 4,726,790 | 2/1988 | Hadjis | 439/620 |
| 4,729,743 | 3/1988 | Farrar et al. | 439/620 |
| 4,729,752 | 3/1988 | Dawson, Jr. et al. | 439/620 |
| 4,733,328 | 3/1988 | Blazej | 29/25.42 |
| 4,772,221 | 9/1988 | Kozlof | 439/620 |
| 4,781,624 | 11/1988 | Shepherd | 439/620 |
| 4,782,310 | 11/1988 | Saburi et al. | 333/185 |
| 4,792,310 | 12/1988 | Hori et al. | 439/620 |
| 4,804,332 | 2/1989 | Pirc | 439/620 |
| 4,815,981 | 3/1989 | Mizuno | 439/876 |

FOREIGN PATENT DOCUMENTS

| | | | |
|---|---|---|---|
| 2190548 | 11/1987 | United Kingdom | 439/608 |

*Primary Examiner*—Gary F. Paumen

*Attorney, Agent, or Firm*—Louis A. Hecht; Stephen Z. Weiss

[57] ABSTRACT

A filter connector is provided for incorporation into signal lines of an electrical component on a vehicle. The filter connector includes a filtering assembly having a plurality of terminals mounted in spaced relationship to a grounding plate. A plurality of capacitors or a capacitor array are mounted electrically to the grounding plate and are connected electrically to the respective terminals. The grounding plate, the capacitors, and portions of the terminals connected to the capacitors are insert molded into a nonconductive housing.

15 Claims, 3 Drawing Sheets

INSERT MOLDED FILTER CONNECTOR

BACKGROUND OF THE INVENTION

The number of electrical components in automotive vehicles have increased substantially in recent years. Trends suggest that the number and complexity of electrical components in vehicles will continue to increase. Many of the electrical components incorporated into automotive vehicles include a plurality of input/output signal carrying lines. For example, a typical automotive radio will include input/output lines extending to an illuminated radio dial, an electric clock incorporated into the radio dial and various power operated controls on the radio. The input/output lines for electrical components on a vehicle generally extend from a printed circuit board to an electrical connector having a plurality of terminals mounted therein. The leads extending from the circuit board to the connector are likely to generate or receive electrical interference, e.g., EMI/RFI. For example, the signals generated by an automotive radio may affect or be affected by other electronic components of the vehicle, such as CB radios, electronic fuel injection systems and electronic braking controls. Additionally, interference generated by electric components on one vehicle conceivably can affect the performance of electrical components on another vehicle. The effects of electrical interference on an automotive radio could be an annoying problem. On the other hand, the effects of electrical interference on an electronic fuel injection system or an electronic braking control could be catastrophic.

Most prior art vehicular radios and other electrical automotive components include capacitors, ferrite suppressors or other such filter means incorporated into the circuitry printed on the circuit board. Although these known suppressors and filters are effective to minimize interference generated on the circuit board, they are of limited effectiveness in filtering signals in the input/output lines leading to or extending from the circuit board. These signal lines external to the circuit board are now known to generate and/or receive a very significant portion of the electrical interference.

The prior art includes many filters mounted on portions of signal carrying circuits external to a circuit board. These prior art attempts have shared several significant deficiencies. In particular, most prior art electrical interference filters disposed at locations external to a circuit board have been complex and relatively expensive. Additionally, these complex prior art filters have not been well suited to long term use in a high vibration automotive environment, and are subject to failure in such an environment.

One such prior art filter is shown in U.S. Pat. No. 4,792,310 which issued to Hori et al. on Dec. 20, 1988. The electrical connector shown in U.S. Pat. No. 4,792,310 includes a shell made from an electrically conductive material. A pair of spaced apart insulating members are supported in parallel relationship within the conductive shell and function to support an array of parallel pin terminals. Each pin terminal passes through an annular capacitor which in turn is mounted to a radiating plate formed from a conductive material and connected to the electrically conductive shell. The annular capacitor elements shown in U.S. Pat. No. 4,792,310 comprise a substantially cylindrical inside electrode mounted to the pin terminal, a cylindrical dielectric mounted around the inside electrode and a cylindrical outside electrode mounted about the dielectric and soldered to the radiating plate. The small annular capacitor elements shown in U.S. Pat. No. 4,792,310 are expensive to manufacture and difficult to assemble. Additionally, the radiating plate shown in U.S. Pat. No. 4,792,310 would be subject to vibration in an automotive environment, with a substantial probability of eventual damage to the complex connections within or adjacent the capacitor elements.

U.S. Pat. No. 4,782,310 issued to Saburi et al. on Nov. 1, 1988 and shows a filter assembly identified for use in a vehicular environment. The filter assembly shown in U.S. Pat. No. 4,782,310 includes a plurality of overlapped thin insulation plates and electrode strips. The structure shown in U.S. Pat. No. 4,782,310 also would be extremely complex and expensive.

U.S. Pat. No. 4,733,328 issued to Blazej on Mar. 22, 1988 and is directed to a particular capacitor array and to a method of making the array. The method involves forming the capacitor directly in place on a grounding plate such that the capacitive element and the grounding plate are heat bonded to on another. The method proceeds by again effectively forming a conductive layer on the previously formed capacitor such that the conductive layer is heat-bonded to the capacitor. The formation of both the capacitor and the conductive layer involves the use of finely divided materials which are heat-sintered and thereby bonded to the adjacent layer of the capacitor array. Although the capacitor array described in U.S. Pat. No. 4,733,328 conceivably could have some application in an automotive environment, it appears to be an extremely expensive product to manufacture.

Another prior art filter assembly is shown in U.S. Pat. No. 4,772,221 which issued to Kozlof on Sept. 20, 1988. This connector filter includes an insulative capacitor housing ring having chip capacitors mounted therein. The insulative capacitor housing ring, the chip capacitors and an assembly of conductive washers are mounted to the connector housing with a lock washer and nut. This complex multicomponent assembly is not well suited for use in an automotive environment.

In view of the above, it is an object of the subject invention to provide a filter connector that is well suited for use in a high vibration automotive environment.

It is another object of the subject invention to provide an electrical connector that is capable of filtering electrical interference generated from or received by the leads extending to and from an electrical component.

An additional object of the subject invention is to provide a filter connector that can be manufactured relatively inexpensively, while still providing exceptional filtering abilities.

SUMMARY OF THE INVENTION

The subject invention is directed to a filter connector that may be incorporated into the input and output signal carrying lines extending from or leading to an electrical component, such as an automotive radio or other automotive apparatus. The filter connector comprises a plurality of electrical terminals having opposed mating ends. The opposed ends of each terminal may define pin terminals or pin receiving terminals.

The filter connector further comprises a grounding plate having means for connection to an external ground. The grounding plate is mounted in selected spaced relationship to the respective terminals. For example, the grounding plate may include a plurality of apertures extending therethrough with the respective terminals extending through the apertures. However, the relative dimensions of the apertures and the terminals are such that the terminals are in spaced relationship to the grounding plate.

The filter connector further comprises capacitor means electrically connected to both the grounding plate and the terminals. The capacitor means may comprise a capacitor array electrically connected to the ground by solder, electrically conductive adhesive or other known electrical connecting means. The capacitor array may further be connected to the terminals by a plurality of electrically conductive connectors corresponding in number to the terminals. The connectors may provide for a resilient connection between the capacitor array and the terminals to account for the vibrations inherent in the automotive environment. The connectors may comprise generally L-shaped brackets that are electrically connected to both the capacitor array and the terminals by, for example, an electrically conductive adhesive, solder or other known connecting means.

The capacitor array may define a known commercially available capacitor array in which a plurality of discrete capacitors are integrally supported in a three-dimensional matrix of nonconductive or dielectric materials which may comprise known ceramic materials used for these purposes.

As an alternate to the above described embodiment, the capacitor means of the subject filter connector may comprise a plurality of discrete chip capacitors which are separately mounted to the grounding plate by solder or an electrically conductive adhesive. Each discrete chip capacitor is then separately electrically connected to a corresponding terminal by an electrically conductive connector. The connector may comprise a generally L-shaped metal bracket electrically connected to a capacitor chip and the corresponding terminal. As with the previously described embodiment, the electrical connection of the connector to the chip capacitor and the terminal may be by solder and/or by an electrically conductive adhesive. Also as set forth in the previous embodiment, the connectors extending between the chip capacitors and the terminals may provide some resiliency for enhanced performance and life in the high vibration automotive environment.

The subject filter connector further comprises a nonconductive housing. The housing preferably is molded from a suitable plastic material. More particularly, the housing of the subject filter connector preferably is injection molded employing insert molding technology such that the capacitor means, the connectors between the capacitor means and the terminals and at least portions of the grounding plate and portions of the terminals define an insert in the nonconductive molded housing. Thus, the housing will define a unitary three-dimensional matrix of nonconductive plastic material completely surrounding and supporting the fragile connections between the capacitor means and the terminals. This unitary three-dimensional matrix of plastic material provides efficient protection for the subject filter connector in the high vibration automotive environment without resorting to the complex multicomponent assemblies of the prior art. Additionally, the flexible electrical connections between the capacitor means and the terminals can offset the effect of any vibration generated deformation or impact generated deformation of the plastic material in which these connectors are insert molded.

DETAILED DESCRIPTION OF THE PREFERRED EMBODIMENTS

Figure 1:
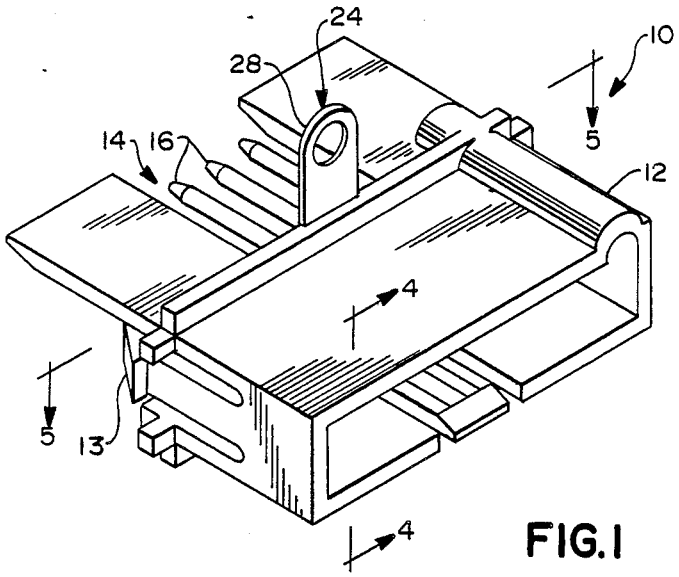
FIG. 1 is a perspective view of the filter connector of the subject invention.

The filter connector of the subject invention is identified generally by the numeral 10 in FIG. 1. The filter connector 10 is intended for application in an automotive environment and may, for example, be incorporated into the input and/or output signal lines of an automotive radio. As noted above, the object of the filter connector 10 is to minimize the effect of electrical interference on the signal carrying leads to or from the radio, and to prevent the leads from generating electrical interference that could affect other electrical components.

As shown in FIG. 1, the filter connector 10 comprises a unitarily molded nonconductive housing 12 into which a filtering assembly 14 is insert molded. The housing 12 includes latch means 13 for locking engagement of the connector 10 to another connector (not shown).

Figure 2:
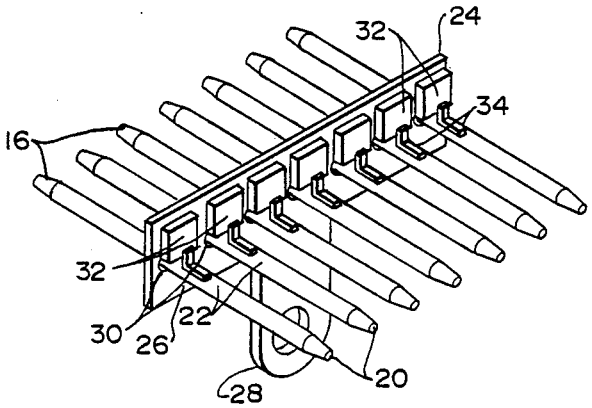
FIG. 2 is a perspective view of the terminals, capacitors, and grounding plate assembly that is insert molded into the filter connector shown in FIG. 1.

The filtering assembly 14 which is insert molded into the nonconductive housing 12 is shown more clearly in FIG. 2. In particular, the filtering assembly 14 comprises a plurality of electrically conductive terminals 16 disposed in a generally parallel array. Each terminal 16 includes opposed mating ends 18 and 20 and an intermediate mounting portion 22. As depicted in FIG. 2, the opposed mating ends 18 and 20 of each terminal 16 define pins. However, other mating configurations may be employed depending upon the characteristics of the circuit into which the filter connector 10 is to be incorporated. For example, each terminal 16 could have a first mating end 18 defining a pin as shown in FIG. 2, but with a second mating end stamped and formed to define a dual slot insulation displacement terminal. Many other terminal configurations may of course be employed.

The filtering assembly 14 further includes a ground identified generally by the numerals 24. The ground is stamped from a unitary piece of conductive material and includes a generally rectangular planar grounding plate 26 and a ground contact 28 extending unitarily therefrom. The grounding plate 26 is stamped to define a plurality of apertures 30 extending therethrough. More particularly, each aperture 30 is dimensioned to enable the mounting portion 22 of a terminal 16 to be directed therethrough and disposed in spaced relationship to the electrically conductive grounding plate 26. As depicted in FIG. 2, the apertures 30 are disposed in a generally linear array. However, other configurations of apertures 30 may be provided depending upon the configuration of the connector to which the filter connector 10 is to be mated.

The filtering assembly 14 comprises a plurality of chip capacitors 32 which are securely mounted to the grounding plate 26 by an electrically conductive adhesive. More particularly, the chip capacitors 32 are disposed in spaced relationship to one another and generally in line with portions of the grounding plate 26 adjacent the apertures 30 therein. The chip capacitors may be formed from a suitable capacitive material such as the known ferrite compounds. Each chip capacitor 32 preferably is of generally square configuration with equal sided edge dimensions of approximately 0.12 inch, and with a thickness of approximately 0.04 inch. Chip capacitors 32 of other dimensions or configurations, of course, may be employed. Furthermore, additional chip capacitors 32 may be employed depending upon the filtering requirements. For example, additional chip capacitors 32 may be mounted to the opposite side of the grounding plate 26, or on the same side of the grounding plate 26 shown in FIG. 2, but on the opposite side of the apertures 30 therein.

The chip capacitors 32 are electrically joined to the terminals 16 by connectors 34. In particular, each connector 34 is formed from a narrow flat strip of metallic material to define a generally L-shape. One leg of each connector 34 is electrically connected to a corresponding chip capacitor 32, while the other leg of each connector 34 is electrically connected to a terminal 16. The connections between the terminals 16, the connectors 34 and the chip capacitors 32 is such that the terminal 16 can be supported in spaced relationship to the periphery of each respective aperture 30 in the grounding plate 26.

Figure 3:
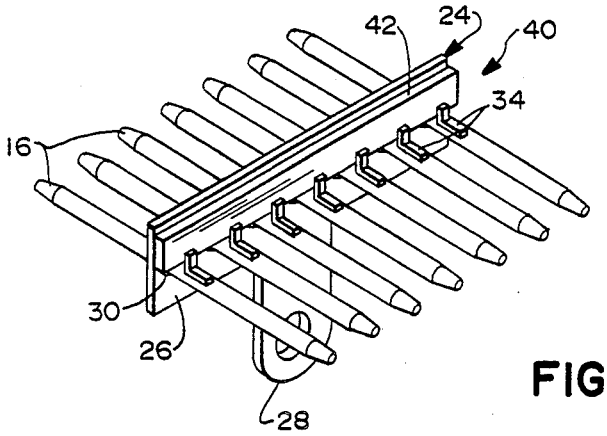
FIG. 3 is a perspective view of an alternate assembly of terminals, capacitors and grounding plate.

An alternate filtering assembly is illustrated in FIG. 3 and is identified generally by the numeral 40. The filtering assembly 40 includes a plurality of terminals 16 which are substantially identical to the terminal 16 identified in FIG. 2. However, as explained above, terminals of other configurations may also be employed, such as terminals having insulation displacement contact portions at one or both ends. The filtering assembly 40 further comprises a ground 24 substantially identical to the ground 24 illustrated in FIG. 2 and described above. As explained above, the ground 24 includes a generally rectangular planar grounding plate 26 and a ground contact 28 extending unitary therefrom. The grounding plate 26 includes a plurality of apertures 30 extending therethrough, as explained with respect to the FIG. 2 embodiment.

The filter assembly 40 differs from the filtering assembly 14 described and illustrated above in that it includes a single capacitor array 42. The capacitor array comprises a plurality of discrete capacitors mounted in a continuous matrix of dielectric material. The spacing of the capacitors (not shown) in the capacitor array 42 corresponds to the spacing between the terminal 16 in the filter assembly 40. The integral capacitor array 42 shown in FIG. 3 is mounted to the grounding plate 26 by a conductive adhesive, solder or other electrical connecting means as explained above. Additionally, the capacitor array 42 is mounted to the grounding plate 26 to be substantially adjacent the apertures 30 formed therethrough.

The filtering assembly 40 further comprises L-shaped connectors 34 substantially identical to those described and illustrated above. The L-shaped connectors 34 are soldered or otherwise appropriately connected electrically to the terminals 16, and are further connected to the capacitors in the capacitor array 42. As explained above, the connectors 34 are mounted to the respective terminal 16 and the capacitor array 42 such that the terminals 16 are supported generally centrally within the apertures 30 and in spaced relationship to the conductive material of the grounding plate 26.

Figure 4:
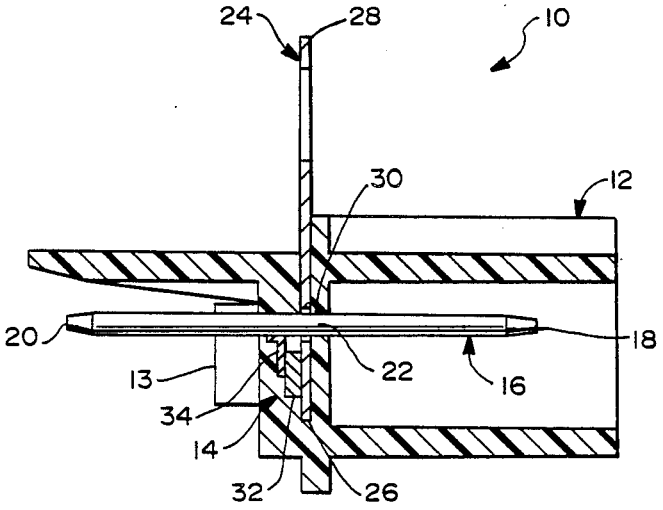
FIG. 4 is a cross sectional view taken along line 4—4 in FIG. 1.
Figure 5:
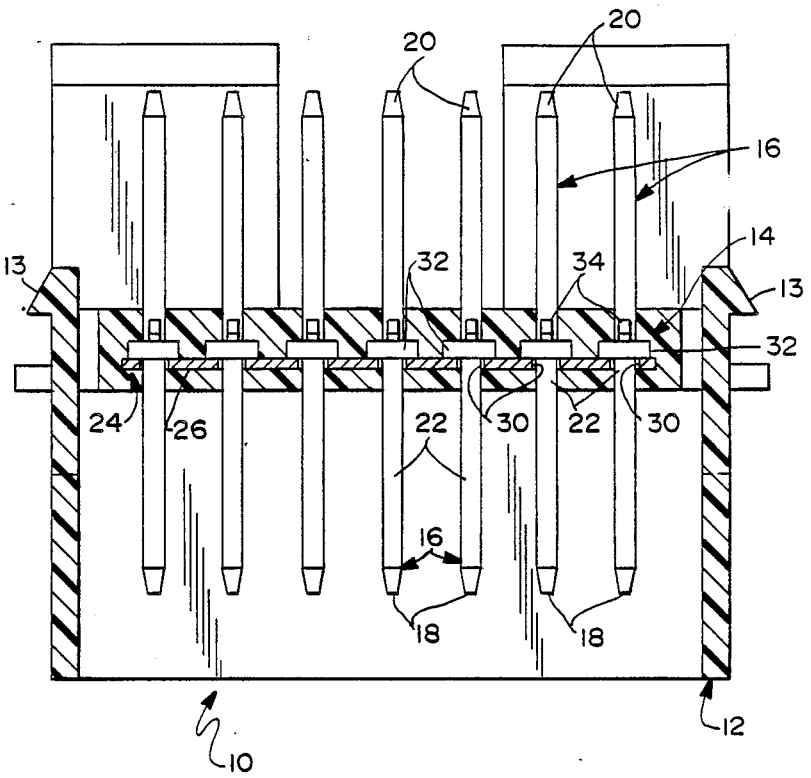
FIG. 5 is a cross sectional view taken along line 5—5 in FIG. 4.

The filtering assembly 14 of FIG. 2 is insert molded into the housing 12, as illustrated most clearly in FIGS. 4 and 5. It is to be understood that the filtering assembly 40 of FIG. 3 could similarly be insert molded into the housing 12. The insert molding is carried out to define a substantially continuous three-dimensional matrix of molded plastic material surrounding the grounding plate 26, the chip capacitors 32 or the capacitor array 42, the L-shaped connectors 34 and the central mounting portions 22 of the respective terminals 16. The ground contact 28 of the ground 24 is dimensioned and disposed to extend from the molded housing 12 to enable a grounding connection to an appropriate ground circuit. The insert molding construction, as shown in FIGS. 4 and 5, provides exceptional support for the small fragile components of the filter connector 10. In particular, the initial placement of the filtering assembly 14 in the injection mold causes the plastic material injected into the mold to completely surround and support the components of the filtering assembly 14 to ensure that each individual component is securely supported relative to the plastic material of the housing 12, and therefore relative to one another. This simple supporting construction with a unitary plastic matrix surrounding the components of the filtering assembly 14 avoids the complex multicomponent assemblies that had been required by the prior art. Additionally, the unitary matrix of plastic material surrounding the components of the filtering assembly 14 provides effective and efficient support in the high vibration environment of an automobile. Any movement of the components of the filtering assembly 14 that may occur due to the resiliency of the plastic matrix defined by housing 12 can readily be accommodated by the resiliency of the L-shaped connectors 34 which electrically and mechanically connect the terminal 16 to the chip capacitors 32 or capacitor array 42.

In summary, a filter connector is provided for incorporation into a signal line of an electrical component used in a high vibration environment, such as an automotive radio. The filter connector comprises a filtering assembly having a plurality of terminals disposed in spaced relationship to a grounding plate. Chip capacitors, capacitor arrays or similar capacitor means are mounted to the grounding plate. Electrical connection is provided between the capacitors and the respective terminals. Portions of the filtering assembly including the capacitors, the grounding plate and areas on the terminals connected to the capacitors are insert molded in a nonconductive housing. As a result, the nonconductive housing defines a unitary three-dimensional nonconductive matrix which surrounds, supports and protects the various interconnected components of the filtering assembly, and prevent damage in the high vibration automotive environment.

While the invention has been described with respect to certain preferred embodiments, it is apparent that various changes can be made without departing from the scope of the invention as defined by the appended claims. For example, and as noted above, the terminals that are insert molded into the filter connector housing may take any of a variety of forms, including terminals having insulation displacement contact portions at one or both ends. The grounding structure also can take many forms other than the planar configuration illustrated above. Similarly, the interconnection between the capacitors and the terminals can take many forms in addition to the specific L-shaped connector members illustrated above. The capacitor means also can take various configurations. These and other variations would be appreciated by a person having skill in this art after having read the preceding disclosure.

We claim:

1. A filter connector having a plurality of electrically conductive terminals, a ground disposed in spaced relationship to the terminals and a plurality of capacitors, each said capacitor being electrically connected to the ground and to one of said terminals, wherein the improvement comprises:

a molded plastic housing defining a continuous unitary plastic matrix surrounding at least the capacitors, portions of the ground electrically connected to said capacitors and resilient generally "L" shaped electrically conductive connector means separate from said capacitors and said terminals for electrically connecting portions of the terminals to the capacitors, each said connector means having two legs generally perpendicular to each other, a side of one leg being electrically attached to a respective said capacitor and a side of the other leg being electrically attached to a side of a respective said terminal where the longitudinal axis of said other leg and said terminal are generally parallel to one another, whereby the unitary matrix of plastic material simultaneously insulates and supports the capacitors, the ground, the terminals, and the connections therebetween.

2. A filter connector as in claim 1 wherein the capacitors define a plurality of discrete chip capacitors, the plastic matrix extending unitarily intermediate the respective chip capacitors of the filter connector.

3. A filter connector as in claim 2 wherein the chip capacitors are electrically connected to the ground by an electrically conductive adhesive.

4. A filter connector as in claim 2 wherein the ground comprises a generally planar grounding plate and a ground contact extending unitarily therefrom, the grounding plate being insert molded into the housing such that a substantially continuous unitary matrix of plastic material surrounds the grounding plate.

5. A filter connector as in claim 4 wherein the grounding plate comprises a plurality of apertures extending therethrough, said terminals extending through the apertures in the grounding plate.

6. A filter connector as in claim 1 wherein the capacitors define integral portions of a capacitor array.

7. A filter connector as in claim 6 wherein the capacitor array is electrically connected to the ground by an electrically conductive adhesive.

8. A filter connector as in claim 6 wherein the ground comprises a generally planar grounding plate and a ground contact extending unitarily from the grounding plate, the grounding plate including a plurality of apertures extending therethrough, with the terminals extending through the apertures in the grounding plate.

9. A filter connector as in claim 1 wherein the housing is of unitary construction and further comprises mounting means for mounting the housing to at least one other electrical connector.

10. A filter connector comprising a plurality of electrically conductive terminals, capacitor means electrically connected to said terminals, ground means electrically connected to said capacitor means and housing means surrounding and protecting the capacitor means and at least portions of said terminals, wherein the improvement comprises;

said ground including a generally planar grounding plate having a plurality of apertures extending therethrough;

said terminals extending through the apertures in spaced relationship to the grounding plate;

the capacitor means comprising a plurality of chip capacitors electrically connected to the grounding plate in proximity to the apertures therein;

a plurality of electrically conductive resilient generally "L" shaped connector means for connecting the chip capacitors to the terminals, each said connector means having two legs generally perpendicular to each other, a side of one said leg being electrically attached to a respective said capacitor and a side of the other said leg being electrically attached to a side of a respective said terminal where the longitudinal axis of said other leg and said terminal are generally parallel to one another; and said housing being molded from a nonconductive material and comprising a continuous unitary three-dimensional matrix surrounding and in supporting contact with the grounding plate, the chip capacitors and portions of the terminals connected thereto;

whereby the continuous matrix defining the housing provides support and protection for the chip capacitors and the electrical connections thereof to the grounding plate and the terminals.

11. A filter connector as in claim 10 wherein the chip capacitors are electrically connected to the grounding plate by an electrically conductive adhesive.

12. A filter connector as in claim 10 wherein the connector means extending between the chip capacitors and the terminal are stamped and formed from unitary strips of electrically conductive material.

13. A filter connector as in claim 10 wherein the continuous matrix of plastic material is defined by insert molding.

14. A filter connector as in claim 10 wherein the electrical connection between each said chip capacitor and the connector means is defined by an electrically conductive adhesive.

15. A filter connector as in claim 10 wherein the housing is unitarily molded and further comprises mating means for mating the filter connector to at least one other connector.

* * * * *